United States Patent [19]

Melino

[11] Patent Number: 4,794,974

[45] Date of Patent: Jan. 3, 1989

[54] INTERIOR CURTAIN WALL

[76] Inventor: Charles E. Melino, 246 Welfare Ave., Warwick, R.I. 02888

[21] Appl. No.: 66,219

[22] Filed: Jun. 25, 1987

Related U.S. Application Data

[63] Continuation-in-part of Ser. No. 836,814, Mar. 6, 1986, abandoned.

[51] Int. Cl.[4] ..... A47H 1/00

[52] U.S. Cl. ..... 160/330; 160/327; 160/350

[58] Field of Search ..... 160/330, 349 R, 349 D, 160/350, 368 R, 354, 327; 248/200.1

[56] References Cited

U.S. PATENT DOCUMENTS

| | | | |
|---|---|---|---|
| 1,398,909 | 11/1921 | North | 160/330 X |
| 2,621,725 | 12/1952 | Shacikoski | 160/368 R X |
| 3,118,363 | 1/1964 | Burgess | 160/330 |
| 3,522,658 | 8/1970 | Howell | 248/200.1 X |
| 3,593,857 | 7/1971 | Hernes | 248/200.1 X |
| 3,715,969 | 2/1973 | Burgess | 160/330 X |
| 3,883,106 | 5/1975 | Simonsen | 248/200.1 X |
| 4,139,101 | 2/1979 | Towfigh | 160/350 X |
| 4,158,896 | 6/1979 | Farkas | 248/200.1 |
| 4,708,189 | 11/1987 | Ward | 160/330 |

*Primary Examiner*—Alvin C. Chin-Shue
*Assistant Examiner*—David M. Purol
*Attorney, Agent, or Firm*—Barlow & Barlow, Ltd.

[57] ABSTRACT

An interior curtain wall to prevent dust being transported from one area to another has an elongated flexible curtain that is supported on a plurality of interconnected headers, each header connected to the next by a flexible hinge and being supported against the ceiling by a support leg that is adjustable in length and has a spring loaded foot to maintain pressure against the header.

3 Claims, 1 Drawing Sheet

INTERIOR CURTAIN WALL

CROSS REFERENCE TO RELATED APPLICATIONS

This application is a continuation-in-part of application Ser. No. 836,814, filed Mar. 6, 1986 now abandoned.

BACKGROUND OF THE INVENTION

When work must be done in an existing location that is occupied, as for example a plaster wall has to be cut, considerable dust and air-blown particles will travel throughout the space being worked upon and into areas not being worked upon. It is therefore necessary in some way to seal off the area being worked upon so that the air-blown particles will not travel beyond that area. In the past, attempts have been made to use drapes, but it is always a problem as to how to fasten the drapes. Nailing to existing structures tends to damage the structure and there exists, therefore, a need to have a simple yet portable structure which can be easily erected by one person and which will seal off the area being worked upon.

In the prior art, there is disclosed a number of curtain wall structures that are primarily designed for a mine ventilation control which have some analogy to the present invention; for example, in the North Patent, U.S. Pat. No. 1,398,909, there is disclosed a curtain wall which is supported by legs, the upper end of each of the legs having a plate on which the curtain may hang. In the Shacikoski Patent, U.S. Pat. No. 2,621,725, another curtain wall is shown being supported by legs and there is illustrated an element 10 which is supported to the ceiling of the mine shaft by brackets as well as being supported at the end by the legs. A disclosure of a spring-loaded leg is seen in the Burgess Patent, U.S Pat. No. 3,118,363, while the Connelly Patent, U.S. Pat. No. 443,133, illustrates a drapery holder consisting of a pair of legs with a bar as a cross member.

SUMMARY OF THE INVENTION

The curtain wall of the invention has a plurality of header elements which are connected together by a flexible hinge while a curtain which has a transverse dimension slightly longer than each of the headers is fastened to each header, each header being connected to an adjacent header by a flexible hinge. To install the curtain wall assembly in the space bounded by the walls and floor of a room, the end header is placed against the ceiling of a room while the remainder of the structure hangs loosely from one end thereof. A support leg which is telescopic in construction engages the underside of the header and forces the same tightly against the ceiling. The installer then moves to the adjacent header and repeats the operation that is completed by placing another support leg in position. And the operation is continued from one wall to another wall. The length of the curtain is sufficient to cover the distance between the ceiling and the floor and provides additional material at the bottom so that wooden weights may be placed against the bottom of the curtain to hold it against the floor. Installation is made extremely simple primarily by the virtue of the flexible hinge that extends from one header to an adjacent header. The flexible hinge preferably will be in the form of a cord or braided strap which permits the adjacent header to hang downwardly while the first is being installed and permits the device to be installed by the utilization of only one person.

DETAILED DESCRIPTION OF THE PREFERRED EMBODIMENT

Figure 1:
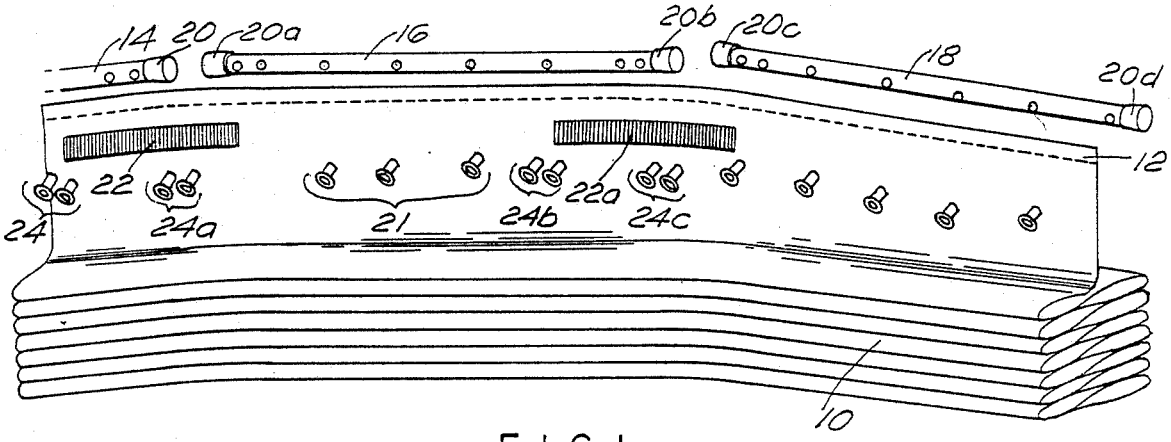
FIG. 1 is view illustrating the elements of the curtain wall assembly.

In referring to FIG. 1, the curtain wall assembly includes a elongated sheet of flexible material such as unbleached muslin cloth 10 with hem pockets 12 along one edge. The header elements 14, 16, and 18 are each formed in an identical fashion and have cushion tips 20, *20a*, *20b*, *20c* and *20d* at each end thereof. Each of the headers are interconnected by a flexible hinge such as a strap 22, *22a*, which may be fastened by fastening means such as 24, *24a*, *24b*, *24c* that are illustrated as rivets. To complete the assembly, a support leg having a main tubular body 28 is provided. The support leg has a foot 30 that is telescopically received in the main body and an upper portion 32 with reduced end 32, which extends out of the main body 28 and which is held in position by a simple cam latch, generally designated 34, as seen in FIG. 3. The cam latch consists essentially of a strap 35 that encircles a tubular body 28 and has a wire pivot rod 36 extending therefrom to which is pivotally attached an aperture plate 37 that, as seen in FIG. 3, can angle into position to latch the upper portion 32 in position relative to the body 28. The lower end of the support leg has a compression spring 40 received against the transverse retaining pin 41, while the foot section has a retainer stud 43 that extends through a slot 44 in the body 28. In this fashion the foot is normally pressed outwardly or to the right as seen in the drawing, but has limited movement upwardly within the distance provided by the slot 44 so that a pressure may always be exerted on the support leg as the reduced end of the upper portion 32 engages an aperture 19 in the header 19. (See FIG. 2)

Figure 2:
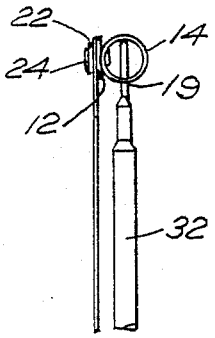
FIG. 2 is a partial elevational view, partly in section illustrating the manner in which the headers remain in position against the ceiling.
Figure 3:
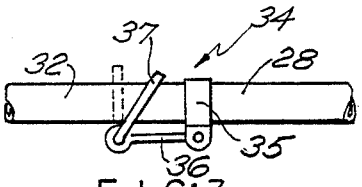
FIG. 3 is a partial longitudinal view illustrating the adjustability of the telescopic support leg.
Figure 4:
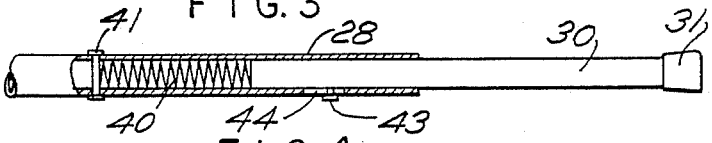
FIG. 4 is a partial view of the bottom section of the leg illustrating the manner in which a spring-loaded foot is utilized.

Referring to FIGS. 1 & 2, we see that the curtain 10 has a portion thereof extending upwardly being fastened to each header by fasteners such as 21 that pass thru the hem pockets 12 at the top edge of the curtain. Between each header there is a fairly large portion of fabric that allows the user to accomodate different widths or spaces between facing walls for instance. Thus by angling the headers one to the other, the curtain wall may be adapted to fit almost any space. Essentially, the pressure exerted by the legs against the headers hold the curtain in place with no extra fastening. The resilient tips 20 resist movement against the ceiling. It will also be noted that the upper end of the support leg is received in an aperture such as an aperture 19 in the headers 14, 16, and 18.

Figure 5:
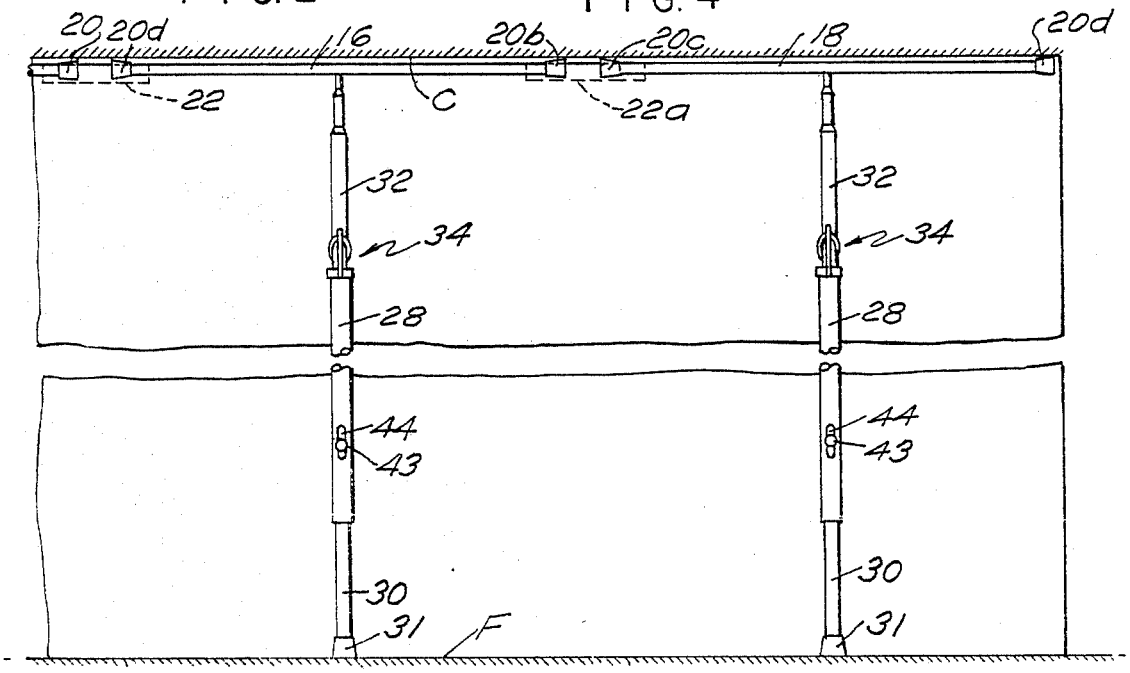
FIG. 5 is an elevational view illustrating the curtain wall assembly of the invention installed.

By referring to FIG. 5, the completed structure is illustrated against a ceiling C, a plurality of sections being supported individually by legs 28 with upward pressure being exerted on each of the legs as the spring presses the foot ends 30 that are fitted with resilient feet 31 downwardly against the floor F. The arrangement of the headers having resilient tips for non-slip engagement with the ceiling and the resilient feet on the legs, make the structure remain in place with no fastening to marr a wall, ceiling or floor. This is an important feature as most of the other assemblies have positive spike or nailing engagement with the surrounding structure.

I claim:

1. An interior curtain wall assembly disposed between a floor and a ceiling comprising a plurality of header elements having terminal ends, the ends of each header element connected to the end of an adjacent element by a flexible strap hinge and having a resilient tip thereon for engagement with said ceiling, said hinge spacing the ends of adjacent headers to allow folding of the assembly, a continuous flexible curtain fastened to each header throughout its length, and a plurality of support legs each being adjustable in length with a spring loaded foot at the lower end to maintain an upward force on each header, each leg engaging at least one header at its upper end and having a resilient foot at the lower end, said resilient tip preventing lateral displacement of the header elements on said ceiling and said resilient foot insuring positive engagement with the floor.

2. An interior curtain wall assembly as in claim 1 wherein each header has at least one aperture therein and said leg has a reduced upper end that engages in said aperture for positive locking with the header.

3. An interior curtain wall assembly as in claim 1 wherein the flexible curtain has hemmed pockets at its upper edge and said header elements are received in the pockets.

* * * * *